US005241895A

United States Patent [19]

Weyer

[11] Patent Number: 5,241,895

[45] Date of Patent: Sep. 7, 1993

[54] AIR-POWERED SPLINED ROTARY ACTUATOR

[76] Inventor: Paul P. Weyer, P.O. Box 398, Enumclaw, Wash. 98022

[21] Appl. No.: 975,797

[22] Filed: Nov. 13, 1992

[51] Int. Cl.[5] ..... F01B 3/00

[52] U.S. Cl. ..... 92/33; 92/31; 92/80; 92/108; 92/147; 92/150; 92/158; 92/159

[58] Field of Search ..... 92/31, 32, 33, 107, 92/147, 150, 151, 108, 156, 158, 159, 80

[56] References Cited

U.S. PATENT DOCUMENTS

| | | | |
|---|---|---|---|
| 2,932,206 | 4/1960 | Tootle | 92/33 |
| 3,200,426 | 8/1965 | Barr | 92/150 |
| 4,838,104 | 6/1989 | Riley | 92/31 |
| 4,882,979 | 11/1989 | Weyer | 92/33 |

FOREIGN PATENT DOCUMENTS

| | | | |
|---|---|---|---|
| 0021889 | 9/1961 | Fed. Rep. of Germany | 92/33 |
| 0272753 | 8/1970 | U.S.S.R. | 92/33 |
| 0785582 | 12/1980 | U.S.S.R. | 92/33 |

*Primary Examiner*—Thomas E. Denion
*Attorney, Agent, or Firm*—Seed and Berry

[57] ABSTRACT

An air-powered actuator having a body with first and second ends, an axially transverse annular bulkhead positioned therebetween, and an output shaft with a splined exterior portion. The body includes first and second end walls with each end wall having a sleeve mounted coaxially within the body about the shaft and projecting axially inward within the body. A piston sleeve is disposed for axial reciprocating movement within the body. The piston sleeve has a pair of piston heads, an outer sleeve, and an inner sleeve. The outer sleeve is mounted coaxially within the body inward of the bulkhead and about the first and second sleeves to define therewith a fluid-tight outer chamber containing the piston heads, each positioned to an opposite side of the bulkhead to define four fluid-tight chambers and to which pressurized air is applied. Also defined is a fluid-tight inner chamber containing lubricating oil. The outer sleeve is attached to the piston heads for reciprocating travel therewith. The inner sleeve is mounted coaxially within the inner chamber, inward of the second sleeve and about the shaft. The inner sleeve is attached to the outer sleeve for reciprocating travel therewith. The inner sleeve has a splined exterior portion meshing with the second sleeve splined interior portion and a splined interior portion meshing with the shaft splined exterior portion to translate axial movement of the piston sleeve into relative rotational movement between the shaft and the body.

9 Claims, 1 Drawing Sheet

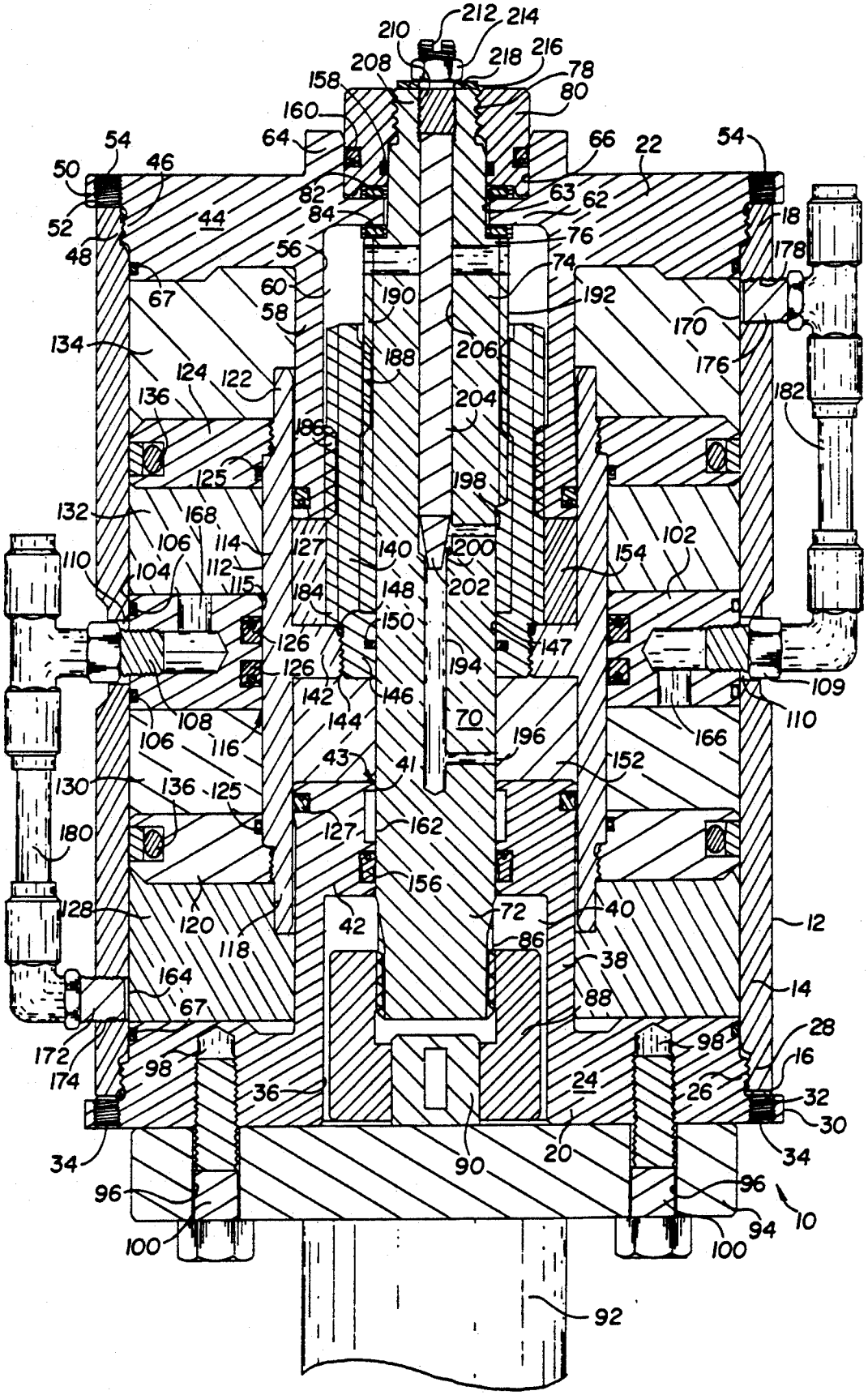
212
214
210
208
218
216
78
80
158
160
64
66
22
54
54
50
46
52
48
44
82
84
63
62
18
178
76
74
56
60
58
67
190
192
170
176
134
124
122
136
188
206
204
182
186
125
198
132
168
106
114
127
140
200
154
102
110
104
112
115
184
148
202
150
126
147
126
194
109
142
146
108
144
70
196
110
106
116
166
43
41
152
130
136
125
127
162
180
156
128
120
118
42
72
40
12
86
38
164
88
14
67
28
172
174
98
98
16
36
24
26
32
30
34
20
34
90
96
96
10
94
100
100
92

AIR-POWERED SPLINED ROTARY ACTUATOR

DESCRIPTION

1. Technical Field

The present invention relates generally to actuators and, more particularly, to an air-powered splined rotary actuator in which axial movement of a piston results in relative movement between a body and an output shaft.

2. Backoround of the Invention

Rotary helical splined actuators have been employed in the past to achieve the advantage of high-torque output from a simple linear piston-and-cylinder drive arrangement. The actuator typically uses a cylindrical body with an elongated rotary output shaft extending coaxially within the body, with an end portion of the shaft providing the drive output. An elongated annular piston sleeve has a sleeve portion splined to cooperate with corresponding splines on the body interior and the output shaft exterior. The piston sleeve is reciprocally mounted within the body and has a head for the application of fluid pressure to one or the other opposing sides thereof to produce axial movement of the piston sleeve. Typically, the fluid used in hydraulic oil under pressure not only causes axial movement of the piston sleeve but also lubricates the splines of the piston sleeve, shaft and body. Without such lubrication, the sliding friction between the piston sleeve, shaft and body would be too great to achieve the desired torque output.

As the piston sleeve linearly reciprocates in an axial direction within the body, the outer splines of the sleeve portion engage the splines of the body to cause rotation of the sleeve portion. The resulting linear and rotational movement of the sleeve portion is transmitted through the inner splines of the sleeve portion to the splines of the shaft to cause the shaft to rotate. Bearings are typically supplied to rotatably support one or both ends of the shaft relative to the body.

While such an arrangement produces a relatively high-torque output when powered by pressurized hydraulic oil, splined rotary actuators do not provide desirable torque output when powered by pressurized air without also providing for some means to lubricate the sliding splines. Also, without lubrication the sliding splines wear quickly. Attempts made to use pressurized air with small amounts of oil mixed therewith to provide lubrication to the sliding splines have not proven successful. Also, supplying the pressurized air-oil mixture involves extra difficulties and expense.

Typical air supplies produce air pressure at 80–100 psi. When using pressurized gas within this pressure range to power a rotary actuator, a large piston is needed with a relatively long stroke to provide sufficient torque output. Of course, the size and weight of the actuator is thereby increased significantly. As such, it is desirable to substantially increase the output torque of the actuator over that normally available without significantly increasing the size or weight of the actuator. This allows construction of a high-output torque even when a low-pressure source is used. One such rotary actuator using at least helical splines between the shaft and the piston sleeve and using dual piston heads with four air chambers is shown in applicant's U.S. Pat. No. 4,882,979. However, this air-powered actuator provides no means for lubricating the sliding splines when connected to apply pressurized gas to all four chambers, and hence experiences higher than desired sliding friction which limits the torque output of the actuator and wearing of the splines.

It will therefore be appreciated that there has long been a significant need for an air-powered splined rotary actuator capable of producing a high-torque output which does not require the mixture of lubricating oil with the pressurized gas. The actuator should also have means for controlling the cycle speed of the piston sleeve operation, and hence the shaft. The present invention fulfills these needs and further provides other related advantages.

SUMMARY OF THE INVENTION

The present invention resides in an air- or other gas-powered actuator with a body having a longitudinal axis, and a shaft extending axially within the body and supported for rotation relative to the body. The shaft has a splined exterior portion. The actuator further includes an end wall attached to one end of the body, and an end sleeve mounted coaxially within the body about the shaft and projecting axially from the end wall toward an opposite end of the body. The end sleeve has a splined interior portion.

The actuator further includes a piston sleeve disposed within the body for axial reciprocating movement. The piston sleeve has a piston head, an outer sleeve and an inner sleeve.

The outer sleeve is mounted coaxially about the end sleeve and defines with the end sleeve a fluid-tight outer chamber to which pressurized gas is applied, and a fluid-tight inner chamber containing lubricating oil. The piston head is disposed in the outer chamber and divides the outer chamber into a first fluid-tight chamber portion to one side thereof and a second fluid-tight chamber portion to an opposite side thereof. The application of pressurized gas to the first chamber portion moves the piston head in one axial direction within the body, and the application of pressurized gas to the second chamber portion moves the piston head in an opposite axial direction within the body. The outer sleeve is attached to the piston head for reciprocating travel therewith.

The inner sleeve is mounted coaxially within the inner chamber inward of the end sleeve and about the shaft. The inner sleeve is attached to the outer sleeve for reciprocating travel therewith. The inner sleeve has a splined exterior portion meshing with the end sleeve splined interior portion and a splined interior portion meshing with the shaft splined exterior portion to translate axial movement of the piston sleeve in one axial direction into one of clockwise or counterclockwise relative rotational movement between the shaft and the body, and axial movement of the piston sleeve in an opposite axial direction into the other of clockwise or counterclockwise relative rotational movement between the shaft and the body.

In an illustrated embodiment of the invention, the actuator includes a first end wall toward a body first end and a second end wall toward a body second end. A first sleeve is mounted coaxially within the body about the shaft toward the body first end, and projects axially from the first end wall toward the body second end and terminates in a free end. A second sleeve is mounted coaxially within the body about the shaft toward the body second end, and projects axially from the second end wall toward the body first end and terminates in a free end. The free ends of the first and second sleeves are axially spaced apart. The second sleeve has a splined interior portion.

The outer sleeve is mounted coaxially about both the first and second sleeves, and extends axially toward the body first end beyond the first sleeve free end and axially toward the body second end beyond the second sleeve free end to define with the first and second sleeves the outer chamber to which the pressurized gas is applied and the inner chamber containing the lubricating oil.

In the illustrated embodiment, a connecting member is disposed in the inner chamber between the first and second sleeve free ends and attaches the inner sleeve to the outer sleeve for reciprocating travel therewith. A first seal is positioned to provide a fluid-tight seal between the outer sleeve and the first sleeve as the piston sleeve reciprocates within the body, and a second seal is positioned to provide a fluid-tight seal between the outer sleeve and the second sleeve as the piston sleeve reciprocates in the body to maintain the lubricating oil within the inner chamber separate from the outer chamber to which pressurized gas is applied.

The connecting member forms a divider dividing the inner chamber into a fluid-tight first inner chamber portion to a side thereof toward the body first end, and a fluid-tight second inner chamber portion to a side thereof toward the body second end. The splined portions are located within the second inner chamber portion, and at least the second inner chamber portion contains the lubricating oil.

A fluid channel communicates the lubricating oil between the first and second inner chamber portions. A valve associated with the fluid channel meters the flow of lubricating oil between the first and second inner chamber portions.

In the illustrated embodiment, the actuator includes dual piston heads which define four fluid-tight outer chamber portions to which pressurized gas is applied.

Other features and advantages of the invention will become apparent from the following detailed description, taken in conjunction with the accompanying drawings.

BRIEF DESCRIPTION OF THE DRAWINGS

FIG. 1 is a side elevational, sectional view of an air-powered rotary spline embodying the present invention.

DETAILED DESCRIPTION OF THE INVENTION

As shown in the drawings for purposes of illustration, the present invention is embodied in an air-powered splined rotary actuator 10. The actuator 10 includes an elongated housing or body 12 having a cylindrical sidewall 14, and first and second ends 16 and 18, respectively. A first end cap 20 is positioned at the body first end 16, and a second end cap 22 is positioned at the body second end 18.

The first end cap 20 has a circular end wall 24 with a threaded perimeter portion 26 which is threadably received within a correspondingly threaded interior wall portion 28 of the body sidewall 14 at the body first end 16. The first cap end wall 24 has a circumferential flange 30. The flange 30 extends radially outward over an annular end wall 32 of the body sidewall 14 at the body first end 16 and has a plurality of circumferentially spaced-apart set screws 34 which engage the body end wall 32 to lock the first end cap 20 in place against rotation relative to the body 12.

The first cap end wall 24 has a central aperture 36. The first end cap 20 further includes an axially inward-projecting sleeve 38 located concentric with the first end wall aperture 36 to form a first end cap cavity 40. An axially inward end of the first end cap cavity 40 is defined by a radially inward-projecting, annular flange 42 positioned at an axially inward end of the first end cap sleeve 38. The first end cap flange 42 has an inner edgewall 41 which defines a central aperture 43. While in the illustrated embodiment the first end cap wall 24, the first end cap sleeve 38 and the first end cap flange 42 are formed as an integral part, they may also be formed as separate parts attached together by threading one to the other or in any other conventional manner.

The second end cap 22 has a circular end wall 44 with a threaded perimeter portion 46 which is threadably received within a correspondingly threaded interior wall portion 48 of the body sidewall 14 at the body second end 18. The second end cap end wall 44 has a circumferential flange 50. The flange 50 extends radially outward over an annular end wall 52 of the body sidewall 14 at the body second end 18 and has a plurality of circumferentially spaced-apart set screws 54 which engage the body end wall 52 to lock the second end cap 22 in place against rotation relative to the body 12.

The second cap end wall 44 has a central aperture 56. The second end cap 22 further includes an axially inward-projecting sleeve 58 located concentric with the second end wall aperture 56 to form a second end cap cavity 60. A radially inward-projecting annular flange 62 is positioned in the second end wall aperture 56, at a location generally coplanar with the second cap end wall 44. The second end cap flange 62 defines a central aperture 63.

The second end cap 22 also includes an axially outward-projecting sleeve 64 located concentric with the second end wall aperture 56 to form an exterior second end cap recess 66. While in the illustrated embodiment the second cap end wall 44, the second end cap sleeve 58, the second end cap flange 62 and the second end cap sleeve 64 are formed as an integral unit, they may be formed as separate parts attached together by threading one to the other or in any other conventional manner. The first and second end caps 20 and 22 each carry a conventional O-ring seal 67 to provide a fluid-tight seal between them and the body sidewall 14.

An elongated rotary output shaft 70 is coaxially positioned within the body 12 and supported for rotation relative to the body, as will be described in more detail below. A first end portion 72 of the shaft 70 extends through the central aperture 43 in the first end cap flange 42 and into the first end cap cavity 40. A second end portion 74 of the shaft 70 extends into the second end cap cavity 60, through the central aperture 63 in the second end cap flange 44 and into the second end cap recess 66. The shaft second end portion 74 has an axially outward-facing shoulder 76 and a reduced diameter portion 78 extending from the shoulder 76 to the free end of the shaft second end portion. The reduced diameter portion 78 is threaded and threadably receives thereon an end nut 80 positioned within the second end cap recess 66. The second end cap flange 62 is positioned between the shoulder 76 and end nut 80.

The shaft 70 is rotatably held in place against axial movement by an annular thrust bearing 82 disposed on the shaft second end portion 74 between the shoulder 76 and the second end cap flange 62, and an annular thrust bearing 84 disposed on the shaft second end portion between the second end cap flange 62 and the end nut 80. A lock screw (not shown) in the end nut 80 serves to lock the end nut against rotation relative to the shaft once the end nut is tightened on the shaft second end portion 74 to the degree desired.

The shaft first end portion 72 has straight splines 86 for drivably engaging straight interior splines of an adapter member 88 attached to a rotatable valve stem 90 of a valve 92. The valve 92 includes a mounting flange 94 with a plurality of circumferentially spaced-apart attachment bolt holes 96. The first cap end wall 24 has a plurality of correspondingly positioned spaced-apart threaded recesses 98. The actuator 10 is attached to the valve mounting flange 94 by attachment bolts 100 projecting through the bolt holes 96 and into the threaded recesses 98. It is to be understood that the invention may be practiced with the shaft 70 rotatably driving the valve stem 90 or some other external device, and the body 12 held stationary with respect to the valve 92, or with the shaft being held stationary and the rotational drive being provided by rotation of the body 12.

The actuator 10 has an axially transverse intermediate annular body wall or bulkhead 102 positioned about midway between the body first and second ends 16 and 18. The bulkhead 102 has an outer circumferential edgewall 104 carrying a pair of conventional O-ring seals 106 to provide a fluid-tight seal between the bulkhead and the body sidewall 14. The bulkhead 102 is held stationary with respect to the body 12 by a pair of threaded fluid fittings 108 and 109 which extend through apertures 110 in the body sidewall 14.

The actuator 10 includes a piston sleeve assembly 112 having an outer sleeve 114. The piston sleeve assembly 112 is disposed within the body 12 for reciprocal movement. The bulkhead 102 has an inner circumferential edgewall 115 which defines a central aperture 116 to slidably receive the outer sleeve 114 therein. The outer sleeve 114 has attached at a threaded first end 118 thereof toward the body first end 16 an annular first piston head 120, and has fixedly attached at a threaded second end 122 thereof toward the body second end 18 an annular second piston head 124. The first and second piston heads 120 and 124 each carry a conventional O-ring seal 125 to provide a fluid-tight seal between them and the outer sleeve 114. The first and second piston heads 120 and 124 are disposed within the body 12 for simultaneous axial reciprocating movement with the outer sleeve 114 which connects the first and second piston heads together against axial and rotational movement relative to each other and the outer sleeve during powered operation of the actuator 10. As such, the first and second piston heads 120 and 124 form a dual piston head assembly for reciprocating movement within the body 12 in unison. It should be noted that the actuator 10 can be constructed utilizing a single piston head or more than two piston heads as required to produce the desired output torque.

The first end cap sleeve 38 projects axially inward within the outer sleeve 114 at the sleeve first end 118, and the second end cap sleeve 58 projects axially inward within the outer sleeve at the sleeve second end 122. The outer sleeve 114 is coaxially and reciprocally mounted within the body 12 coaxially about the shaft 70, and the first and second end cap sleeves 38 and 58.

The inner edgewall 115 of the bulkhead 102 carries a pair of conventional seals 126 to provide a fluid-tight seal between the bulkhead and a corresponding exterior smooth wall portion of the sleeve 114, which has sufficient axial length to accommodate the full stroke of the first and second piston heads 120 and 124 within the body 12. The first and second end cap sleeves 38 and 58 each carry a conventional seal 127 to provide a fluid-tight seal between them and the outer sleeve 114 which, as will be described below, provides a seal to prevent the mixture of pressurized air which powers the actuator 10 and lubricating oil contained with the outer sleeve.

The first piston head 120 is positioned between the first cap end wall 24 and the bulkhead 102 to define a first fluid-tight chamber 128 between the first cap end wall and the first piston head, and a second fluid-tight chamber 130 between the first piston head and the bulkhead. The second piston head 124 is positioned between the bulkhead 102 and the second cap end wall 44 to define a third fluid-tight chamber 132 between the bulkhead and the second piston head, and a fourth fluid-tight chamber 134 between the second piston head and the second cap end wall.

The first and second piston heads 120 and 124 each carry a conventional seal 136 positioned between them and a corresponding interior smooth wall portion of the body sidewalls 14. The smooth sidewall portion has sufficient axial length to accommodate the full stroke of the piston heads within the body 12.

The piston sleeve assembly 112 also includes an inner sleeve 140 which is positioned coaxially within the outer sleeve 114, and coaxially about the shaft 70. The outer sleeve 114 has a radially inward-projecting, annular flange 142 defining a threaded central aperture 144. The inner sleeve 140 has a head portion 146 at an end toward the body first end 16 which is threadably received within the threaded central aperture 144 to attach the inner sleeve 140 to the outer sleeve 114 for reciprocating movement within the body 12 in unison. The inner sleeve head portion 146 has a central aperture 147 through which the shaft 70 extends. A conventional seal 148 is disposed between the outer and inner sleeves 114 and 140 to provide a fluid-tight seal therebetween. The inner sleeve 140 carries a conventional seal 150 to provide a fluid-tight seal between the inner sleeve and a corresponding exterior smooth wall portion of the shaft 70 which has sufficient axial length to accommodate the full stroke of the first and second piston heads 120 and 124 within the body 12.

The outer sleeve flange 142 and the inner sleeve head portion 146 together form a chamber divider wall positioned between the first end cap flange 42 and the second end cap flange 62, and define a fifth fluid-tight chamber 152 between the first end cap flange and the divider wall and a sixth fluid-tight chamber 154 between the divider wall and the second end cap flange. The inner edgewall 41 of the first end cap flange 42 carries a conventional seal 156 to prevent fluid leakage from the fifth chamber 152 to the exterior of the actuator 10. The end nut 80 carries a conventional inner seal 158 to provide a fluid-tight seal between the end nut and the second end portion 74 of the shaft 70 and a conventional outer seal 160 to provide a fluid-tight seal between the end nut and the second end cap sleeve 64 to prevent fluid leakage from the sixth chamber 154 to the exterior of the actuator 10. The inner edgewall 41 of the first end cap flange 42 also carries a radial bearing 162 to support the shaft 70 against radial loading.

The actuator 10 is provided with four ports communicating with the four fluid-tight chambers 128, 130, 132 and 134. A first port 164 is located in the body sidewall 14 and communicates with the first chamber 128. A second port 166 is located in the bulkhead 102 and communicates with the second chamber 130. A third port 168 is also located in the bulkhead 102 and communicates with the third chamber 132. A fourth port 170 is located in the body sidewall 14 and communicates with the fourth chamber 134.

The fluid fittings 108 and 109 previously mentioned which hold the bulkhead 102 stationary also communicate pressurized air to the second and third ports 166 and 168, respectively, formed in the bulkhead. A similar fluid fitting 172 is threadably received in a threaded aperture 174 in the body sidewall 14 and communicates pressurized air to the first port 164. A fluid fitting 176 is threadably received in a threaded aperture 178 in the body sidewall 14 and communicates pressurized air to the fourth port 170.

The actuator 10 is shown and described connected for maximum torque operation. When so connected, reciprocation of the first and second piston heads 120 and 124 occurs as a unit within the body 12 when air under pressure selectively enters either through the first and third ports 164 and 168 which are externally connected together by a connector tube 180 to a suitable conventional source of pressurized air or other gas (not shown) to simultaneously apply air pressure to both the first and third chambers 128 and 132, or through the second and fourth ports 166 and 170 which are externally connected together by a connector tube 182 to the pressurized air source to simultaneously apply air pressure to the second and fourth chambers 130 and 134. The application of pressurized air to the first and third chambers 128 and 132 produces axial movement of the piston sleeve assembly 112, comprised of the first and second piston heads 120 and 124 and the outer and inner sleeves 114 and 140 toward the body second end 118. The application of pressurized air to the second and fourth chambers 130 and 134 produces axial movement of the piston sleeve assembly 112 toward the body first end 16. The actuator 10 provides relative rotational movement between the body 12 and the shaft 70 through the conversion of linear movement of the piston sleeve assembly 112 produced by the pressurized air into rotational movement of the shaft, as will be described in more detail below.

The inner sleeve 140 of the piston sleeve assembly 112 has outer helical splines 184 formed on a portion of its length which mesh with inner helical splines 186 formed on an inward-facing end portion of the second end cap sleeve 58. The inner sleeve 140 also has inner helical splines 188 formed on an inward-facing end portion which mesh with outer helical splines 190 formed on a splined portion 192 of the second end portion 74 of the shaft 70 toward the shaft reduced diameter portion 78.

As will be readily understood, reciprocation of the piston sleeve assembly 112 within the body 12 occurs when air under pressure selectively enters either through the first and third ports 164 and 168 to one side of the first and second piston heads 120 and 124 toward the body first end 16 or through the second and fourth ports 166 and 170 to the other side of the first and second piston heads 120 and 124 toward the body second end 18. As the piston sleeve assembly 112 linearly reciprocates in an axial direction within the body 12, the outer helical splines 184 of the inner sleeve 140 engage or mesh with the inner helical splines 186 of the second end cap sleeve 58 to cause rotation of the piston sleeve assembly. The linear and rotational movement of the piston sleeve assembly 112 is transmitted through the inner helical spline 188 of the inner sleeve 140 to the outer helical splines 190 of the splined portion 192 of the shaft 70 to cause the shaft 70 to rotate. Since the longitudinal movement of the shaft 70 is restricted by the second end cap flange 62 in combination with the end nut 80 and the shaft shoulder 76, movement of the piston sleeve assembly 112 is converted into rotational movement of the shaft 70. Depending on the slope and direction of turn of the various helical splines, there may be provided a multiplication of the rotary output of the shaft 70.

The actuator 10 provides relative rotational movement between the body 12 and the shaft 70 through the conversion of linear movement of the piston sleeve assembly 112 into rotational movement of the shaft. In a manner well known in the art, the conversion is accomplished by transmitting torque between the piston sleeve assembly 112 and the second end cap sleeve 58 (which is held stationary with respect to the body 12) in response to reciprocating movement of the piston sleeve assembly and by transmitting torque between the piston sleeve assembly and the shaft 70 in response to reciprocating movement of the piston sleeve assembly.

As noted above, pressurized air is applied simultaneously to two chambers on the same axial side of the first and second piston heads 120 and 124, thus providing doubling of the normal torque output which would result from use of a single piston head. The axial force created by air pressure on the first and second heads 120 and 124 causes the piston sleeve assembly 112 to move axially and transmits rotational force to the shaft 70 since axial movement of the shaft is restricted. The shaft 70 is rotated clockwise or counterclockwise, depending upon the slope and turn of the various helical splines.

The ability to produce twice the normal torque output is the result of providing the actuator 10 with four fluid-tight chambers 128, 130, 132 and 134 so that the pressurized air is applied against the two piston heads 120 and 124 at once, and also providing adequate sealing to prevent air leakage between the chambers. The actuator 10 includes the needed large piston head area for pressurized air operation to produce adequate torque output. It is to be understood that while the illustrated embodiment of the invention has been described as using two piston heads, the invention may be practiced using a single piston head. Additionally, the actuator 10 may be constructed as a linear actuator, with the shaft 70 partially or completely restrained against rotation but permitted to move axially within the body 12 in response to reciprocation of the first and second piston heads 120 and 124.

The illustrated embodiment of the invention is connected for maximum torque output on the shaft 70. While this increases output torque, reduced actuator life can be expected unless the torque-transmitting splines are lubricated. Also, without lubrication the output torque will be reduced. The present invention allows pressurized air to be applied to all four chambers to achieve maximum torque output and provides for lubrication of the sliding splines by filling the fifth and sixth chambers 152 and 154 with hydraulic oil. As previously noted, the interior area defined by the second end cap sleeve 58, the outer sleeve 114, the second end cap flange 62 and the first end cap flange 42 is divided into the fifth and sixth chambers 152 and 154 by the chamber divider wall (formed by the outer sleeve flange 142 and the inner sleeve head portion 146). All of the torque-transmitting splines 184, 186, 188 and 190 are located in the sixth chamber 154 and lubricated by the hydraulic oil that fills the sixth chamber. This lubricating of the sliding splines allows high-output torque with minimum spline wear using a relatively low-pressure source of pressurized air.

The fifth and sixth chambers 152 and 154 are connected by a fluid channel 194 that is formed within the shaft 70 and has a port 196 communicating with the fifth chamber 152 and a port 198 communicating with the sixth chamber 154 to permit the passage of hydraulic oil between the two chambers as the piston sleeve assembly 112, and hence the chamber divider wall, reciprocates during air-powered operation of the actuator 10. The fluid channel 194 includes a valve seat 200 which, in conjunction with a needle valve 202, is used to meter the flow of hydraulic oil between the fifth and sixth chambers 152 and 154 as the piston sleeve assembly 112 reciprocates. This provides a means for accurately controlling the speed at which the actuator 10 is driven by the pressurized air, and for cushioning of the piston sleeve assembly 112. It is noted that while the volume of each of the fifth and sixth chambers 152 and 154 changes as the chamber divider wall moves when the piston sleeve assembly 112 reciprocates within the body 12, the total volume displacement of the two chambers remains constant and the hydraulic oil simply flows back and forth between the two chambers through the fluid channel 194.

The needle valve 202 is connected to a valve stem 204 which is rotatably disposed in a central bore 206 in the shaft 70. The shaft bore 206 has a threaded portion 208 at its end toward the body second end 18 which threadably receives a correspondingly threaded end portion 210 of the valve stem 204. The valve stem 204 has an end slot 212 by which the valve stem may be turned to set the position of the needle valve 202 with respect to the valve seat 200 in order to selectively control the flow of hydraulic oil between the fifth and sixth chambers 152 and 154. A lock nut 214 is used to lock the valve stem 204 in the selected position. A washer 216 containing a conventional O-ring 218 is positioned between the lock nut 214 and the free end of the shaft 70 to prevent fluid leakage.

As noted above, in addition to the control provided by the hydraulic oil, the use of hydraulic oil in the fifth and sixth chambers 152 and 154 has the benefit of providing lubrication to the sliding splines 184, 186, 188 and 190 to reduce the drag and wear they experience and increase the operating efficiency of the actuator 10. This is accomplished while the two seals 127 prevent the oil from contaminating the first, second, third and fourth fluid-tight chambers 128, 130, 132 and 134 to which pressurized air is applied.

It should be noted that actuator 10 can be constructed with lubricating hydraulic oil only present in the sixth chamber 154 in which all of the torque-transmitting splines 184, 186, 188 and 190 are located with the hydraulic oil vented to an external reservoir as the piston sleeve assembly 112 reciprocates. Alternately, the seals 148 and 150 can be eliminated or flow passageways provided in or which bypass the chamber divider wall formed by the outer sleeve flange 142 and the inner sleeve head portion 146 to allow the free flow of hydraulic oil between the fifth and sixth chambers 152 and 154. This design eliminates the need for forming the fluid channel within the shaft 70, or using the valve seat 200 or needle valve.

It will be appreciated that although a specific embodiment of the invention has been described herein for purposes of illustration, various modifications may be made without departing from the spirit and scope of the invention. Accordingly, the invention is not limited except as by the appended claims.

I claim:

1. A gas-powered actuator comprising:

a body having a longitudinal axis, and first and second ends;

a shaft extending axially within said body and supported for rotation relative to said body, said shaft having a splined exterior portion;

a first end wall toward said body first end and attached thereto;

a first sleeve mounted coaxially within said body about said shaft toward said body first end, and projecting axially from said first end wall toward said body second end and terminating in a free end;

a second end wall toward said body second end and attached thereto;

a second sleeve mounted coaxially within said body about said shaft toward said body second end, and projecting axially from said second end wall toward said body first end and terminating in a free end axially spaced apart from said first sleeve free end, said second sleeve having a splined interior portion;

a piston sleeve disposed within said body for axial reciprocating movement, said piston sleeve having a piston head, an outer sleeve and an inner sleeve, said outer sleeve being mounted coaxially about said first and second sleeves, said outer sleeve extending axially toward said body first end beyond said first sleeve free end and axially toward said body second end beyond said second sleeve free end to define with said first and second sleeves an outer chamber to which pressurized gas is applied and an inner chamber containing lubricating oil, said piston head being disposed in said outer chamber and dividing said outer chamber into a first fluid-tight chamber portion to a side thereof toward said body first end and a second fluid-tight chamber portion to a side thereof toward said body second end, the application of pressurized gas to said first chamber portion moving said piston head toward said body second end and the application of pressurized gas to said second chamber portion moving said piston head toward said body first end, said outer sleeve being attached to said piston head for reciprocating travel therewith, said inner sleeve being mounted coaxially within said inner chamber, inward of said second sleeve and about said shaft, said inner sleeve having a splined exterior portion meshing with said second sleeve splined interior portion and a splined interior portion meshing with said shaft splined exterior portion to translate axial movement of said piston sleeve toward one of said body first or second ends into clockwise relative rotational movement between said shaft and said body, and axial movement of said piston sleeve toward the other of said body first or second ends into counterclockwise relative movement between said shaft and said body;

a connecting member disposed in said inner chamber between said first and second sleeve free ends and attaching said inner sleeve to said outer sleeve for reciprocating travel therewith;

a first seal positioned to provide a fluid-tight seal between said outer sleeve and said first sleeve as said piston sleeve reciprocates within said body to maintain the lubricating oil within said inner chamber separate from said outer chamber to which pressurized gas is applied; and a second seal positioned to provide a fluid-tight seal between said outer sleeve and said second sleeve as said piston sleeve reciprocates within said body to maintain the lubricating oil within said inner chamber separate from said outer chamber to which pressurized gas is applied.

2. The actuator of claim 1 wherein said connecting member forms a divider dividing said inner chamber into a fluid-tight first inner chamber portion to a side thereof toward said body first end and a fluid-tight second inner chamber portion to a side thereof toward said body second end, said second sleeve splined interior portion, said shaft splined exterior portion, and said inner sleeve splined exterior and interior portions being located within said second inner chamber portion, at least said second inner chamber portion of said inner chamber containing the lubricating oil.

3. The actuator of claim 2, further including a fluid channel which communicates the lubricating oil between said first and second inner chamber portions.

4. The actuator of claim 3, further including a valve associated with said fluid channel metering the flow of the lubricating oil between said first and second inner chamber portions.

5. A gas-powered actuator comprising:

a body having a longitudinal axis, and first and second ends;

a shaft extending axially within said body and supported for rotation relative to said body, said shaft having a splined exterior portion;

a first end wall toward said body first end and attached thereto;

a first sleeve mounted coaxially within said body about said shaft toward said body first end, and projecting axially from said first end wall toward said body second end;

a second end wall toward said body second end and attached thereto;

a second sleeve mounted coaxially within said body about said shaft toward said body second end, and projecting axially from said second end wall toward said body first end, said second sleeve having a splined interior portion;

a piston sleeve disposed within said body for axial reciprocating movement, said piston sleeve having a piston head, an outer sleeve and an inner sleeve, said outer sleeve being mounted coaxially about said first and second sleeves, said outer sleeve defining with said first and second sleeves a fluid-tight outer chamber to which pressurized gas is applied and a fluid-tight inner chamber containing lubricating oil, said piston head being disposed in said outer chamber and dividing said outer chamber into a first fluid-tight chamber portion to a side thereof toward said body first end and a second fluid-tight chamber portion to a side thereof toward said body second end, the application of pressurized gas to said first chamber portion moving said piston head toward said body second end and the application of pressurized gas to said second chamber portion moving said piston head toward said body first end, said outer sleeve being attached to said piston head for reciprocating travel therewith, said inner sleeve being mounted coaxially within said inner chamber, inward of said second sleeve and about said shaft, said inner sleeve being attached to said outer sleeve for reciprocating travel therewith, said inner sleeve having a splined exterior portion meshing with said second sleeve splined interior portion and a splined interior portion meshing with said shaft splined exterior portion to translate axial movement of said piston sleeve toward one of said body first or second ends into clockwise relative rotational movement between said shaft and said body, and axial movement of said piston sleeve toward the other of said body first or second ends into counterclockwise relative movement between said shaft and said body.

6. The actuator of claim 5, further including a first seal positioned to provide a fluid-tight seal between said outer sleeve and said first sleeve as said piston sleeve reciprocates within said body, and a second seal positioned to provide a fluid-tight seal between said outer sleeve and said second sleeve as said piston sleeve reciprocates within said body, said first and second seals maintaining the lubricating oil within said inner chamber separate from said outer chamber to which pressurized gas is applied.

7. A gas-powered actuator comprising:

a body having a longitudinal axis, and first and second ends;

an axially transverse annular bulkhead positioned within said body between said body first and second ends;

a shaft extending axially within said body and supported for rotation relative to said body, said shaft having a splined exterior portion;

a first end wall toward said body first end and attached thereto;

a first sleeve mounted coaxially within said body about said shaft toward said body first end, and projecting axially from said first end wall toward said body second end;

a second end wall toward said body second end and attached thereto;

a second sleeve mounted coaxially within said body about said shaft toward said body second end, and projecting axially from said second end wall toward said body first end, said second sleeve having a splined interior portion;

a piston sleeve disposed within said body for axial reciprocating movement, said piston sleeve having first and second piston heads, an outer sleeve and an inner sleeve, said outer sleeve being mounted coaxially within said body inward of said bulkhead and about said first and second sleeves, said outer sleeve defining with said first and second sleeves a fluid-tight outer chamber to which pressurized gas is applied and a fluid-tight inner chamber containing lubricating oil, said first and second piston heads being disposed in said outer chamber with said first piston head axially positioned to a side of said bulkhead toward said body first end and said second piston head axially positioned to a side of said bulkhead toward said body second end, and dividing said outer chamber into a first fluid-tight chamber portion between said first piston head and said first end wall, a second fluid-tight chamber portion between said first piston head and said bulkhead, a third fluid-tight chamber portion between said second piston head and said bulkhead, and a fourth fluid-tight chamber portion between said second piston head and said second end wall, the application of pressurized gas to said first and third chamber portions moving said piston head toward said body second end and the application of pressurized gas to said second and fourth chamber portions moving said piston head toward said body first end, said outer sleeve being attached to said first and second piston heads for reciprocating travel therewith, said inner sleeve being mounted coaxially within said inner chamber, inward of said second sleeve and about said shaft, said inner sleeve being attached to said outer sleeve for reciprocating travel therewith, said inner sleeve having a splined exterior portion meshing with said second sleeve splined interior portion and a splined interior portion meshing with said shaft splined exterior portion to translate axial movement of said piston sleeve toward one of said body first or second ends into clockwise relative rotational movement between said shaft and said body, and axial movement of said piston sleeve toward the other of said body first or second ends into counterclockwise relative movement between said shaft and said body.

8. The actuator of claim 7, further including a first seal positioned to provide a fluid-tight seal between said outer sleeve and said first sleeve as said piston sleeve reciprocates within said body, and a second seal positioned to provide a fluid-tight seal between said outer sleeve and said second sleeve as said piston sleeve reciprocates within said body, said first and second seals maintaining the lubricating oil within said inner chamber separate from said outer chamber to which pressurized gas is applied.

9. A gas-powered actuator comprising:

a body having a longitudinal axis;

a shaft extending axially within said body and supported for rotation relative to said body, said shaft having a splined exterior portion;

an end wall attached to one end of said body;

an end sleeve mounted coaxially within said body about said shaft and projecting axially from said end wall toward an opposite end of said body, said end sleeve having a splined interior portion; and a piston sleeve disposed within said body for axial reciprocating movement, said piston sleeve having a piston head, an outer sleeve and an inner sleeve, said outer sleeve being mounted coaxially about said end sleeve and defining with said end sleeve a fluid-tight outer chamber to which pressurized gas is applied and a fluid-tight inner chamber containing lubricating oil, said piston head being disposed in said outer chamber and dividing said outer chamber into a first fluid-tight chamber portion to one side thereof and a second fluid-tight chamber portion to an opposite side thereof, the application of pressurized gas to said first chamber portion moving said piston head in one axial direction within said body and the application of pressurized gas to said second chamber portion moving said piston head in an opposite axial direction within said body, said outer sleeve being attached to said piston head for reciprocating travel therewith, said inner sleeve being mounted coaxially within said inner chamber, inward of said end sleeve and about said shaft, said inner sleeve being attached to said outer sleeve for reciprocating travel therewith, said inner sleeve having a splined exterior portion meshing with said end sleeve splined interior portion and a splined interior portion meshing with said shaft splined exterior portion to translate axial movement of said piston sleeve in one axial direction into one of clockwise or counterclockwise relative rotational movement between said shaft and said body, and axial movement of said piston sleeve in an opposite axial direction into the other of clockwise or counterclockwise relative movement between said shaft and said body.

* * * * *